US006672010B1

(12) United States Patent
Gledhill et al.

(10) Patent No.: US 6,672,010 B1
(45) Date of Patent: Jan. 6, 2004

(54) CASEMENT WINDOW OPERATOR WITH ADJUSTABLE BUSHING

(75) Inventors: Steven Anthony Gledhill, Old Saybrook, CT (US); Tobias Peter Dallas, Old Saybrook, CT (US)

(73) Assignee: Roto Frank of America, Inc., Essex, CT (US)

( * ) Notice: Subject to any disclaimer, the term of this patent is extended or adjusted under 35 U.S.C. 154(b) by 131 days.

(21) Appl. No.: 09/670,431

(22) Filed: Sep. 26, 2000

(51) Int. Cl.[7] ..... E05F 11/24
(52) U.S. Cl. ..... 49/341; 49/339
(58) Field of Search ..... 49/339, 341, 345, 49/346, 333, 335, 337; 74/417, 89.18

(56) References Cited

U.S. PATENT DOCUMENTS

| | | | | | |
|---|---|---|---|---|---|
| 2,022,036 | A | | 11/1935 | Haberstump | |
| 2,214,280 | A | | 9/1940 | Lang | |
| 2,214,884 | A | | 9/1940 | Kistner | |
| 2,686,669 | A | | 8/1954 | Johnson | |
| 2,817,511 | A | * | 12/1957 | Reynaud | 49/249 |
| 3,098,647 | A | | 7/1963 | Teggelaar et al. | |
| 3,250,038 | A | | 5/1966 | Steel | |
| 3,523,389 | A | * | 8/1970 | Gray | 49/324 |
| 4,189,248 | A | | 2/1980 | Sully | |
| 4,209,266 | A | | 6/1980 | Bowen et al. | |
| 4,253,276 | A | * | 3/1981 | Peterson et al. | 49/249 |
| 4,445,794 | A | | 5/1984 | Sandberg | |
| 4,860,493 | A | | 8/1989 | Lense | |
| 5,152,103 | A | * | 10/1992 | Tucker et al. | 49/279 |
| 5,205,074 | A | | 4/1993 | Guhl et al. | |
| 5,272,837 | A | | 12/1993 | Nolte et al. | |
| 5,493,813 | A | | 2/1996 | Vetter et al. | |
| 5,531,045 | A | * | 7/1996 | Piltingsrud | 49/279 |
| 5,531,138 | A | | 7/1996 | Vetter | |
| 5,623,784 | A | * | 4/1997 | Kuersten et al. | 49/342 |
| 5,802,913 | A | * | 9/1998 | Winner | 74/89.18 |
| 5,839,229 | A | * | 11/1998 | Briggs et al. | 49/246 |
| 5,937,582 | A | * | 8/1999 | Taylor | 49/341 |
| 6,122,863 | A | * | 9/2000 | Tippin et al. | 49/279 |
| 6,128,858 | A | | 10/2000 | Vetter et al. | |
| 6,247,270 | B1 | * | 6/2001 | Huml | 49/341 |

FOREIGN PATENT DOCUMENTS

| | | |
|---|---|---|
| FR | 2 467 954 | 4/1981 |

* cited by examiner

*Primary Examiner*—Gregory J. Strimbu
(74) *Attorney, Agent, or Firm*—Marshall, Gerstein & Borun

(57) ABSTRACT

A housing assembly which can accommodate either one of a split arm drive mechanism and a dual arm drive mechanism for a casement window. The housing assembly includes an escutcheon and a base as well as an adjustable bushing that is adjustable to at least two positions, one for the split arm drive mechanism and the other for the dual arm drive mechanism. A worm drive assembly is contained within the housing assembly for driving the drive mechanism. A handle is snap fitted into the worm drive assembly for rotating the worm drive assembly and moving the casement window. A spacer is mounted to the base to enable the base to fit a wide variety of window configurations.

19 Claims, 12 Drawing Sheets

18
10b
17
49
16
15
11
51
12

CASEMENT WINDOW OPERATOR WITH ADJUSTABLE BUSHING

FIELD OF THE INVENTION

The present invention relates to an operator or drive mechanism for a casement window. Still more specifically, the present invention relates to a single casement window operator which may be used for both dual arm and split arm drive mechanisms. Still more specifically, the present invention relates to a casement window operator which incorporates a spacer underneath the base to provide a water barrier between the operator and the window.

BACKGROUND OF THE INVENTION

Casement window operators are known and typically include a hand crank that drives a worm gear and an arm or lever which pushes the window sash open. The worm gear is meshed with a gear segment which is part of a lever or linkage assembly that is connected to the sash. The worm gear includes shafts at each end with one of the shafts being splined. The splined shaft is received in the end of the crank or handle. The worm gear and gear segment are partially accommodated within a housing or escutcheon with the splined shaft of the worm gear extending outward through the housing to mateably engage the crank. When the crank is turned, the worm gear causes the gear segment and lever to rotate which causes the sash to pivot on its hinges between open and closed positions.

There are three general types of casement operators. One type is a single arm operator. The single arm operator has an arm which pivots about an axis that is fixed with respect to the window frame and worm gear. The remote end of the arm carries a bearing which slides in a track mounted to the underside of the sash. The single arm operator is made in a wide range of sizes in order to accommodate a range of sash widths. An advantage to the single arm is its ability to open a sash. One disadvantage with single arm operators is the torque required to move the sash towards its fully open position. Specifically, because of the sliding connection between the arm and the sash, the torque required to move the sash increases as the sash moves between its closed and open positions. Near the fully open position, the amount of torque required to twist the handle or crank may be unacceptably high.

A second conventional casement operator is the split arm operator. This operator is similar to the single arm operator in that it includes a drive arm that rotates about a fixed axis with respect to the worm gear. However, a split arm operator also includes a second arm that has a pivot joint in the middle of the second arm and the remote end of the second arm is secured through a pivotable mounting to a fixed point on the sash. The split arm operator is manufactured in a variety of sizes so there is a split arm operator suitable for most sizes of residential windows. A disadvantage of the split arm operator is its difficulty in opening a sash. On the other hand, an advantage of the split arm operator is its ability to extend the sash to its fully open position.

A third conventional type of window operator is the dual arm operator. The dual arm operator includes features common to both the single arm and split arm operators. Specifically, the dual arm operator includes one arm which rotates about a fixed axis in the housing and which carries at its far end a bearing to slide in a track mounted to the window sash, similar to the single arm operator. The dual arm operator also includes a second arm which has a pivot joint and which is secured at its remote end by a pivotable but fixed connection to the sash, similar to the split arm operator. Dual arm operators come in a variety of sizes to handle a variety of sash sizes.

Dual arm operators and split arm operators require different housing designs due to the different spacings between the rotational axes for the arms that rotate about a fixed axis and the worm gear. Specifically, both the dual arm operator and the split arm operator have a gear sector which rotates about a fixed axis. The radius of the gear sector for the split arm operator is larger than the radius of the gear sector for the dual arm operator. Accordingly, the distance between the rotational axis and the worm gear for the split arm operator is greater than the distance between the rotational axis and the worm gear for the dual arm operator. Hence, the base portion of the housing for the split arm operator must be configured differently than the base portion for the dual arm operator. However, this is inconvenient and costly given the fact that manufacturers often choose to utilize a single style design for both dual arm operators and single arm operators. It would be more cost efficient to generate an escutcheon/base combination which could be utilized for both split arm and dual arm operators.

Further, with both split arm and dual arm operators, the worm gear is equipped with a splined shaft that protrudes outward through the escutcheon. The splined shaft is mateably received in a shaped opening in the crank. If the crank or handle is removed, the unsightly splined shaft is left exposed. Even if a protective cap is provided for the splined shaft, the cap and shaft still protrude outwardly from the escutcheon and do not provide the sleek, low profile appearance that many interior designers and consumers demand. Therefore, there is a need for an improved worm gear assembly which provides an escutcheon having a low profile and which permits removal of the crank or handle without leaving an unsightly shaft protruding outward from the escutcheon.

Further, vinyl windows are manufactured by a number of different companies, with a number of different profiles. Accordingly, it is difficult to provide a single operator with a base that is capable of fitting the large number of vinyl window profiles that are present in the marketplace. Accordingly, there is a need for an improved base design which can be adapted to a wide variety of window profiles. Such a design would enable a single operator to be used on most or all of the vinyl windows currently being manufactured.

SUMMARY OF THE INVENTION

The present invention satisfies the aforenoted needs by providing an improved casement window operator that includes a base and an escutcheon that forms a housing for accommodating a drive gear. The base includes an elongated recess. The operator also includes a bushing. The bushing comprises an elongated flange that has a first end and a second end. The flange is connected to a shaft that extends upward from the flange. The shaft is connected to the flange at an eccentric position that is closer to the first end of the flange than the second end of the flange. The flange of the bushing is mateably accommodated in the recess of the base. The drive gear is mounted onto the shaft. The bushing may be removed from the shaft, rotated and reinserted into the recess to relocate the shaft and the drive gear with respect to the base.

By rotating the bushing, 180°, the rotational axis of the drive gear represented by the shaft of the bushing is relocated within the housing. As a result, the distance between the rotational axis of the drive gear from the worm gear is either shortened or lengthened. For a dual arm operator, the bushing is rotated so that the shaft is closer to the worm gear; for a split arm operator, the bushing is rotated so the shaft is farther away from the worm gear.

In an embodiment, the flange further comprises a raised surface that surrounds the shaft. The raised surface acts as a bearing support for the drive gear.

In an embodiment, the shaft comprises an axial hole extending through the shaft. The axial hole accommodates a screw. Further, the recess of the base also comprises two holes. A first hole accommodates the screw and is in alignment with the axial hole of the shaft when the flange of the bushing is mateably accommodated in the elongated recess in a first position. The second hole accommodates the screw and is in alignment with the axial hole of the shaft when the flange of the bushing has been rotated and is mateably accommodated in the recess in a second position.

In an embodiment, the flange comprises an underside. The underside of the flange comprises a protrusion that is spaced apart from the axial hole of the shaft. The protrusion is mateably accommodated in the second hole of the base when the bushing is in the first position. The protrusion is also mateably accommodated in the first hole of the base when the bushing is in the second position.

In an embodiment, the escutcheon comprises an underside and the shaft comprises a top end disposed opposite the shaft from the flange. The top end of the shaft engages the underside of the escutcheon.

In an embodiment, the underside of the escutcheon comprises a first recess and a second recess. The first recess receives the top end of the shaft when the bushing is in the first position; the second recess receives the top end of the shaft when the bushing is in the second position.

In an embodiment, the top end of the shaft is tapered.

In an embodiment, the first end of the flange of the bushing comprises a notch and the second end of the flange of the bushing comprises a notch. The first end of the elongated recess comprises a projection for mateably engaging the notch of the first end of the flange or the notch of the second end of the flange. Further, the second end of the elongated recess also comprises a projection for mateably engaging the notch of the first end of the flange or the notch of the second end of the flange.

In an embodiment, the base comprises an underside which comprises a lower portion disposed in registry with the escutcheon and a stepped upper portion that extends rearward from the lower portion. The window operator further comprises a spacer that engages the stepped upper portion of the underside of the base.

In an embodiment, the spacer is detachably and slidably connected to the stepped upper portion of the underside of the base.

In an embodiment, the present invention provides an improved worm drive assembly that is housed entirely within the housing defined by the base and the escutcheon as follows. Specifically, the base comprises an angled recess and an angled support. The worm drive assembly comprises a worm gear, a lower thrust bushing, a drive coupling and a retainer bushing. The worm gear comprises two ends, each end of the worm gear comprising a shaft. The shaft of one end of the worm gear is mateably received in the lower thrust bushing which, in turn, is received in the angled recess of the base. The shaft of the other end of the worm gear is mateably received in the drive coupling which, in turn, is mateably received in the retainer bushing. The retainer bushing engages the angled support of the base. The worm drive assembly is disposed entirely between the escutcheon and the base.

In an embodiment, the escutcheon comprises an underside and the retainer bushing comprises a top end that engages the underside of the escutcheon.

In an embodiment, the angled support of the base and the recess of the base support the worm drive assembly at an angle with respect to the base.

In an embodiment, the casement window operator further comprises a handle. The handle comprises an end. The escutcheon further comprises a hole for receiving the handle. The hole is in registry with the worm drive assembly. The end of the handle is mateably received in the top end of the retainer bushing.

In an embodiment, the end of the handle comprises a sidewall with a circumscribed recess. The top end of the retainer bushing comprises a radially inwardly protruding bead. The bead is received in the circumscribed recess of the end of the handle when the end of the handle is mateably received in the top end of the retainer bushing.

Other advantages and objects of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the present invention.

In the drawings.

It should be understood that the drawings are not necessarily to scale and that the embodiments are sometimes illustrated by phantom lines and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
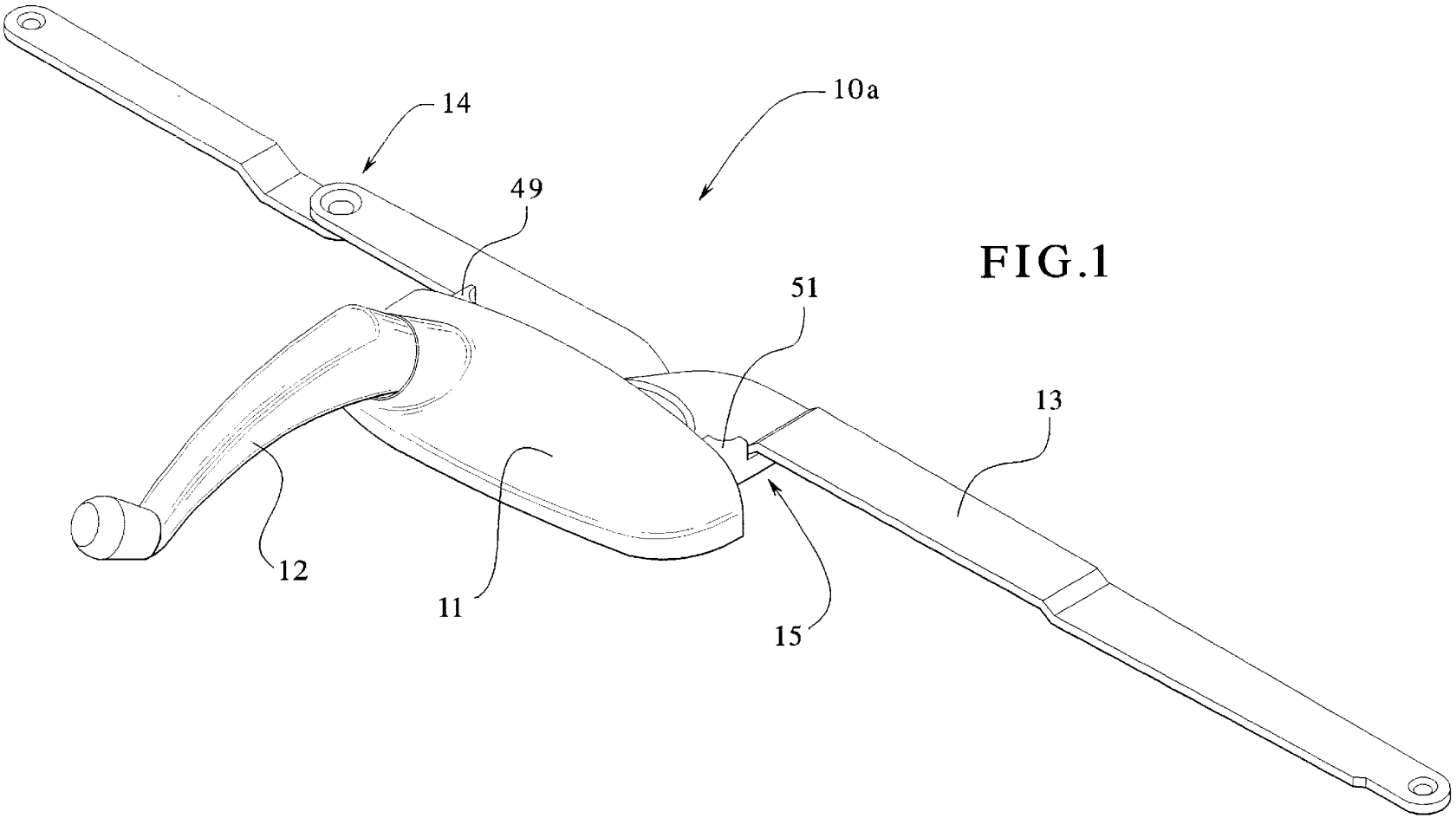
FIG. 1 is a perspective view of the operator housing made in accordance with the present invention and fitted with a split arm drive mechanism.
Figure 2:
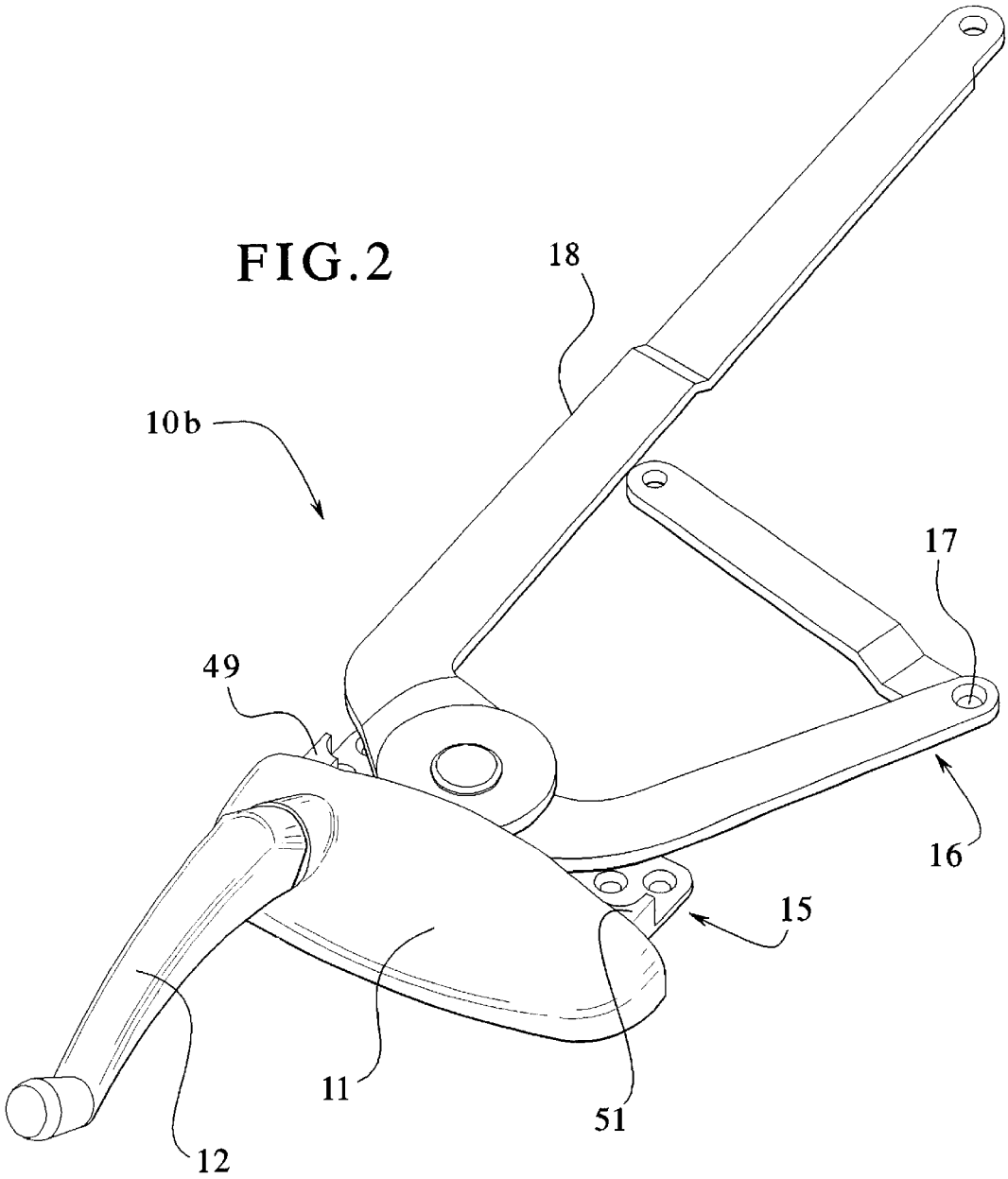
FIG. 2 is a perspective view of the housing of the present invention as equipped with a dual arm drive mechanism.

FIG. 1 illustrates, in a perspective view, a split arm operator assembly 10*a* which includes an escutcheon 11, a crank or handle 12, a driven arm 13 and a second arm 14. The split arm operator assembly 10*a* also includes a base 15. The base 15 and escutcheon 11 form a housing for the drive mechanism which will be discussed below. Similarly, FIG. 2 illustrates a dual arm operator assembly 10*b* that includes the same escutcheon 11, handle 12 and base 15 shown in FIG. 1. However, the dual arm operator assembly 10*b* includes a different driven arm 16 that includes a pivot joint 17 in the middle thereof and a non-jointed second arm 18.

Figure 4:
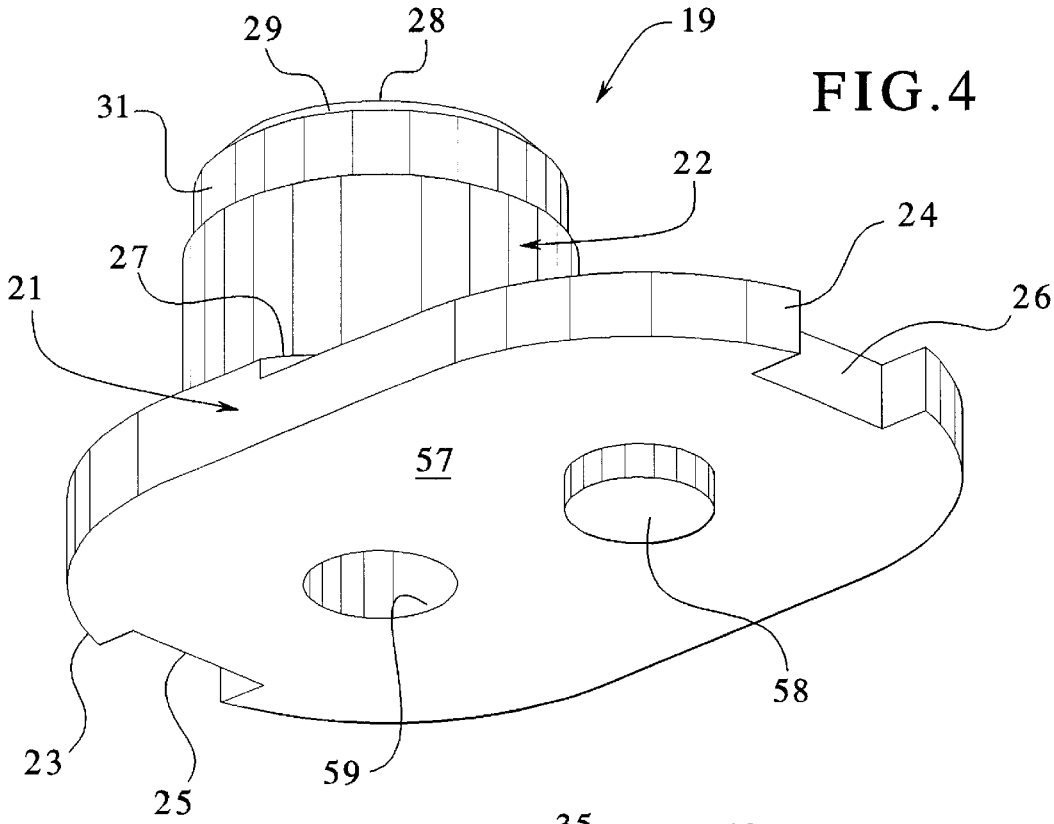
FIG. 4 is a bottom perspective view of the bushing shown in FIG. 3.
Figure 3:
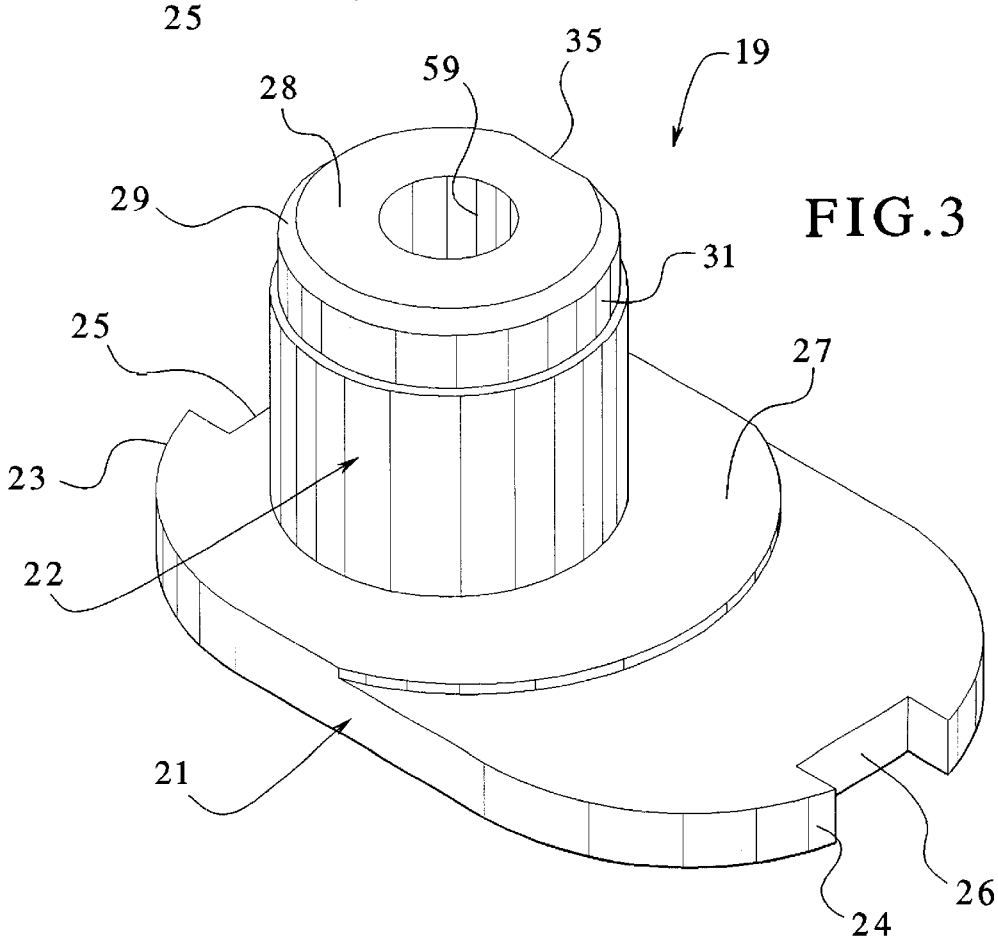
FIG. 3 is a perspective view of the dual position center bushing of the present invention which enables the rotational axis of a drive gear to be relocated with respect to the worm gear thereby enabling a single housing structure to accommodate both a split arm drive mechanism as well as a dual arm drive mechanism.
Figure 16:
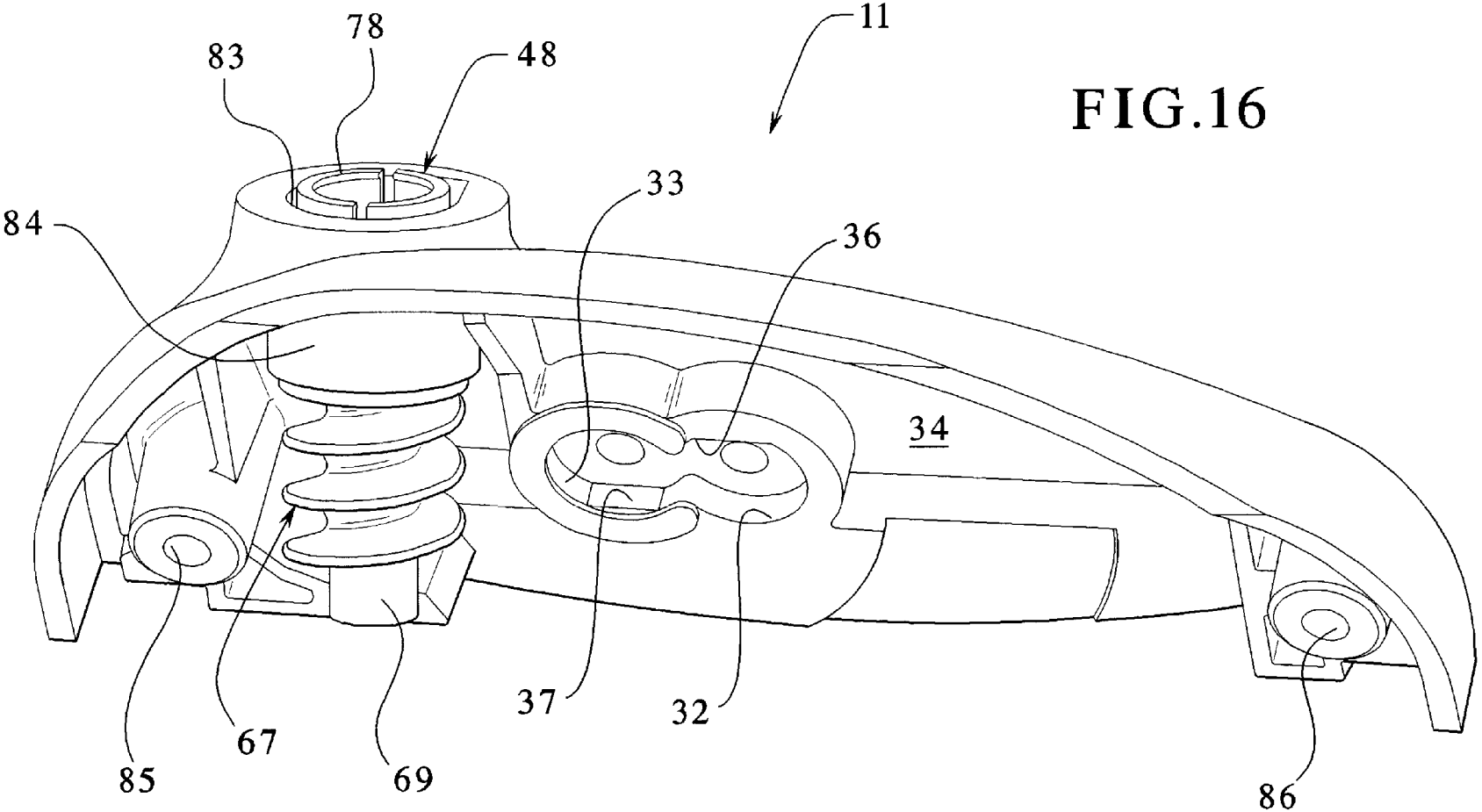
FIG. 16 is a bottom perspective view of the escutcheon and worm drive assembly of the present invention.
Figure 17:
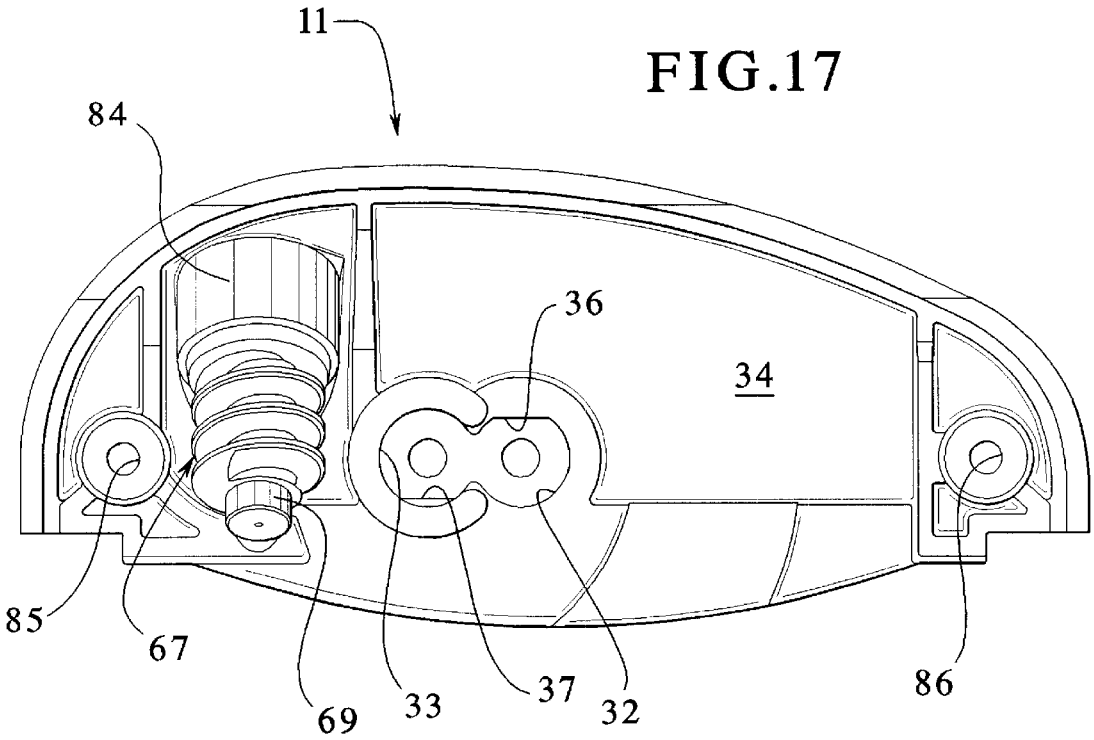
FIG. 17 is a bottom perspective view of the escutcheon and worm drive assembly of the present invention.
Figure 18:
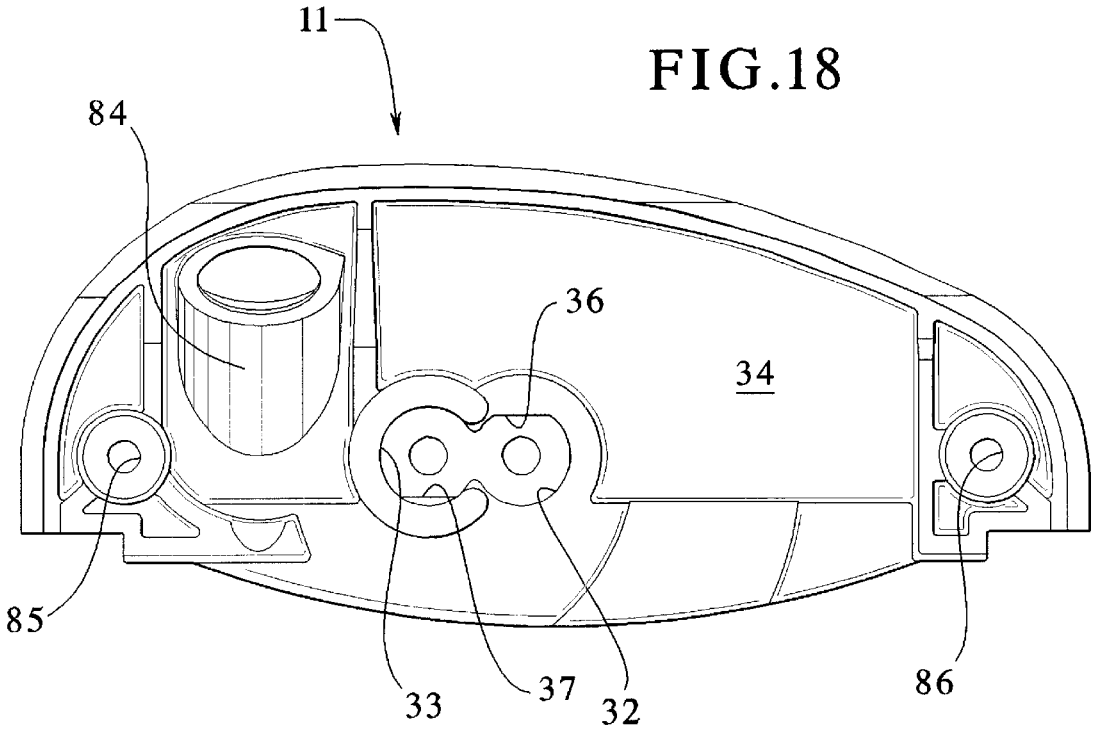
FIG. 18 is a bottom perspective view of the escutcheon of the present invention.

One principle component, in addition to the base 15, that enables the present invention to provide a housing formed by the escutcheon 11 and base 15 which can be readily adapted to both the split arm drive mechanism and dual arm drive mechanism is the center bushing 19 illustrated in FIGS. 3 and 4. Specifically, the bushing 19 includes an elongated flange 21 that is connected to a shaft 22. The shaft 22 is connected eccentrically to the flange 21. That is, the shaft 22 is connected closer to one end 23 of the flange 21 than the other end 24 of the flange 21. Each end 23, 24 of the flange 21 includes a locating notch 25, 26 respectively. Further, surrounding the shaft 22 is a raised surface 27. As will be discussed below, the raised surface 27 provides a bearing surface for the gear end of either the split arm drive mechanism or dual arm drive mechanism. Further, as will be discussed below, the top end 28 of the shaft 23 is tapered by way of the beveled surface 29 and recessed surface 31. Configuration enables the top end 28 of the shaft 22, to be received in one of two locating recesses 32, 33 disposed in the underside 34 of the escutcheon 11 as shown in FIGS. 16 and 17. Further, the flattened surface 35 of the top end 28 of the shaft 22, engages the flattened surface 36 of the recess 32 or the flattened surface 37 of the recess 33 of the escutcheon 11 as shown in FIGS. 16 and 17 as depending upon the position of the bushing 19 in the recess 38 of the base 15 as shown in FIGS. 5–6.

Figure 5:
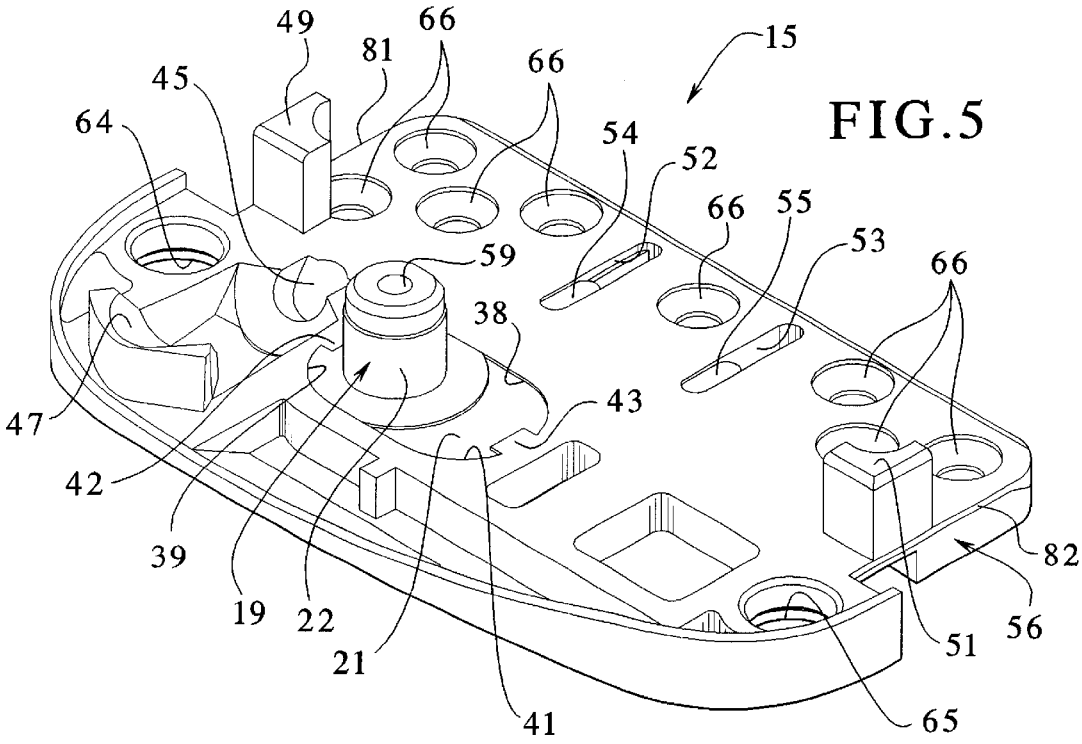
FIG. 5 is a perspective view of the base portion of the housing of the present invention with the bushing of FIG. 3 in a first position.
Figure 6:
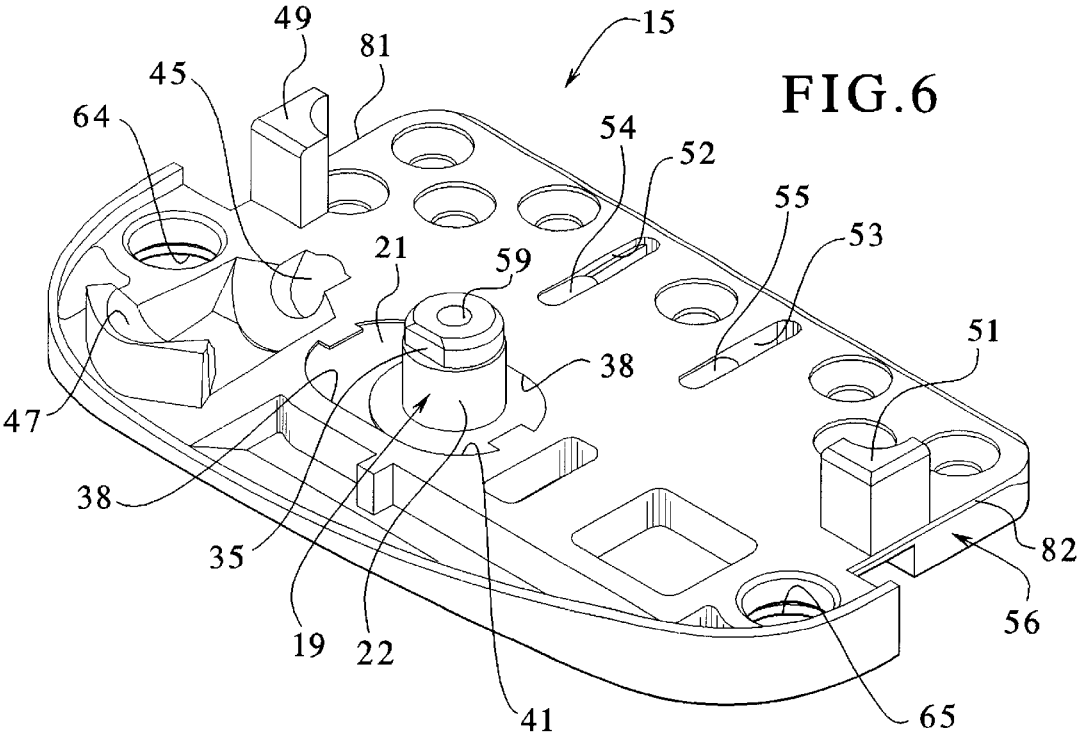
FIG. 6 is a perspective view of the base portion of the housing of the present invention with the bushing of FIG. 3 in a second position.

Turning to FIGS. 5–6, the elongated recess 38 of the base 15 is shown receiving the elongated flange 21 of the bushing 19 in two positions. Turning to FIG. 5, it will be noted that with the bushing 19 rotated as shown in FIG. 5 and received in the recess 38, the shaft 22 is disposed adjacent to one end 39 of the elongated recess 38 as opposed to the other end 41 of the elongated recess 38. In the position shown in FIG. 5, the shaft 22 is disposed closer to the worm drive assembly (not shown in FIG. 5) and therefore the position of the shaft 22 as shown in FIG. 5 is suitable for a dual arm drive mechanism. In contrast, as shown in FIG. 6, the shaft 22 is disposed adjacent to the end 41 of the elongated recess 38 and therefore farther away from the worm drive assembly (not shown in FIG. 6). Accordingly, the configuration shown in FIG. 6 is suitable for a split arm drive mechanism. Therefore, by utilizing the combination of the elongated recess 38 and the appropriately shaped bushing 19, two drive mechanisms can be accommodated utilizing a single base 15 and therefore a single housing design provided by the combination of the escutcheon 11 and base 15.

Still referring to FIGS. 5 and 6, the elongated recess 38 is equipped with two protruding members 42, 43 disposed at the opposing ends 39, 41 of the elongated recess 38 respectively. The protruding members 42, 43 are received in the notches 25, 26 of the elongated flange 21 of the bushing 19 (see FIGS. 3 and 4).

Figures 9, 10:
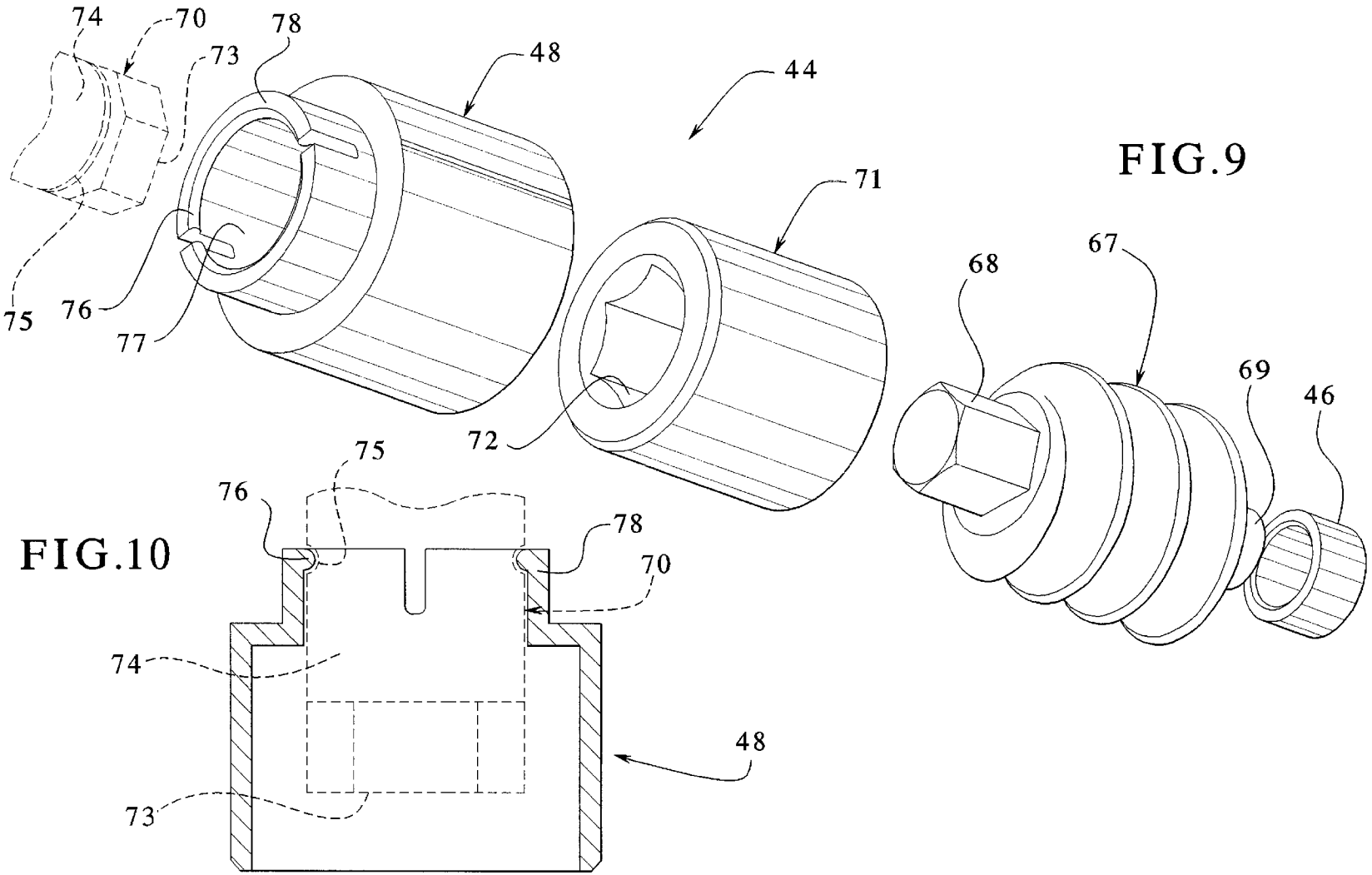
FIG. 9 is an exploded view of the worm drive assembly of the present invention.
FIG. 10 is a sectional view of the retainer bushing shown in FIG. 9 and a partial view of an end of a crank or handle.
Figure 11:
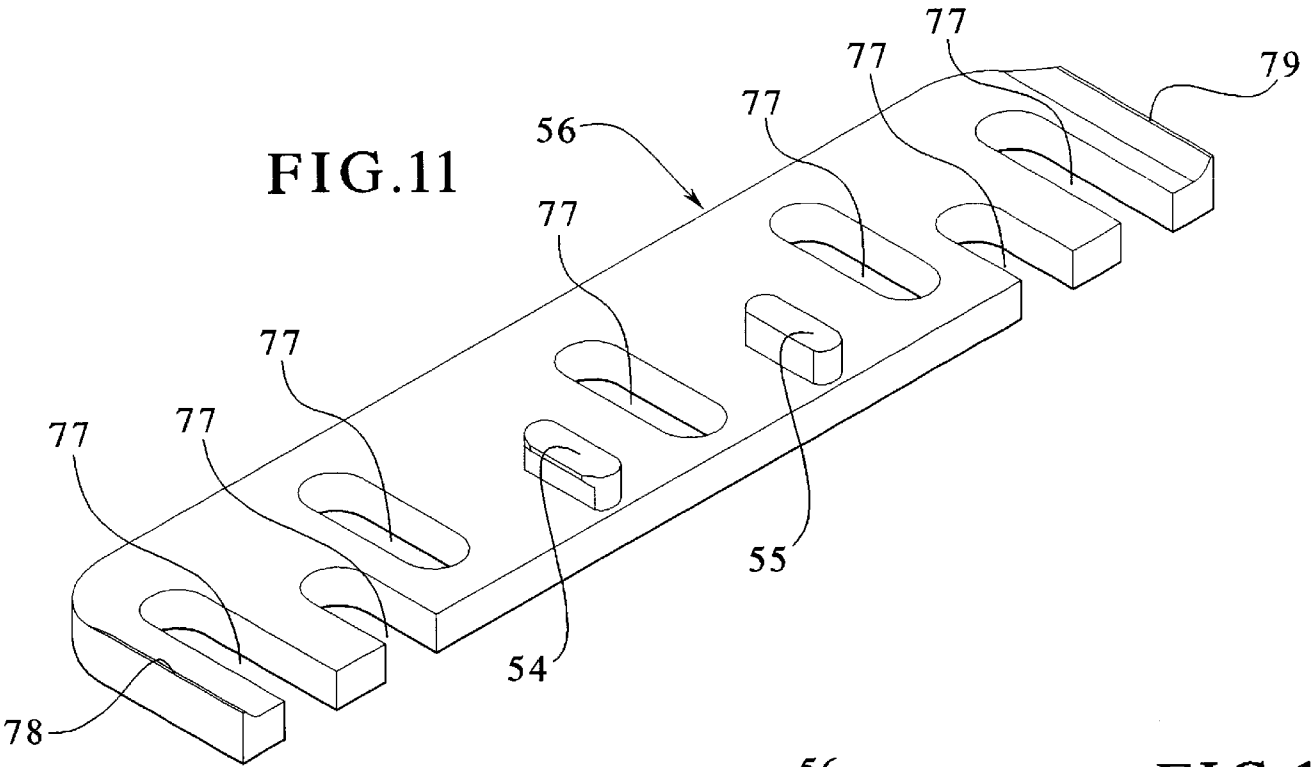
FIG. 11 is a perspective view of a spacer made in accordance with the present invention.
Figure 12:
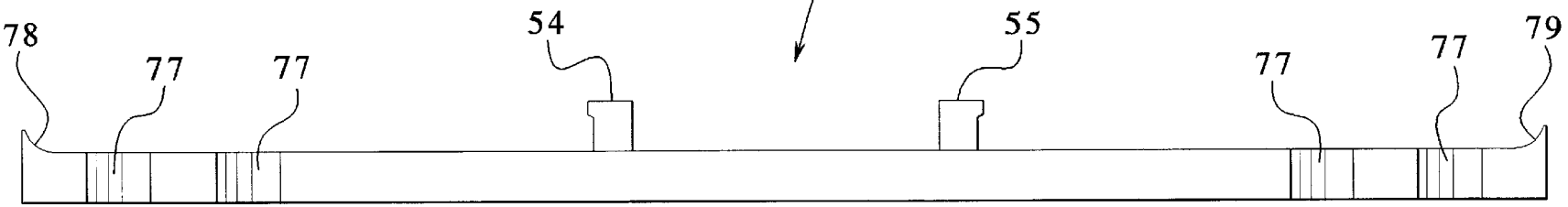
FIG. 12 is a side plan view of the spacer shown in FIG. 11.

Still referring to FIGS. 5 and 6, the base 15 also provides support for the worm drive assembly 44 shown in FIG. 9. Referring to FIGS. 5, 6 and 9 collectively, the base 15 includes an angled recess 45 which supports the lower thrust bearing 46. The base 15 also includes an angled support 47 which supports the retainer bushing 48. Stops 49 and 51 are provided to engage the arms 14, 18 and 13, 16 of the operator assemblies 10*a*, 10*b* as shown in FIGS. 1 and 2. Also shown in FIGS. 5 and 6 are the elongated slots 52, 53 which receive the protruding member 54, 55 of the spacer 56 as shown in FIGS. 11 and 12.

Figure 15:
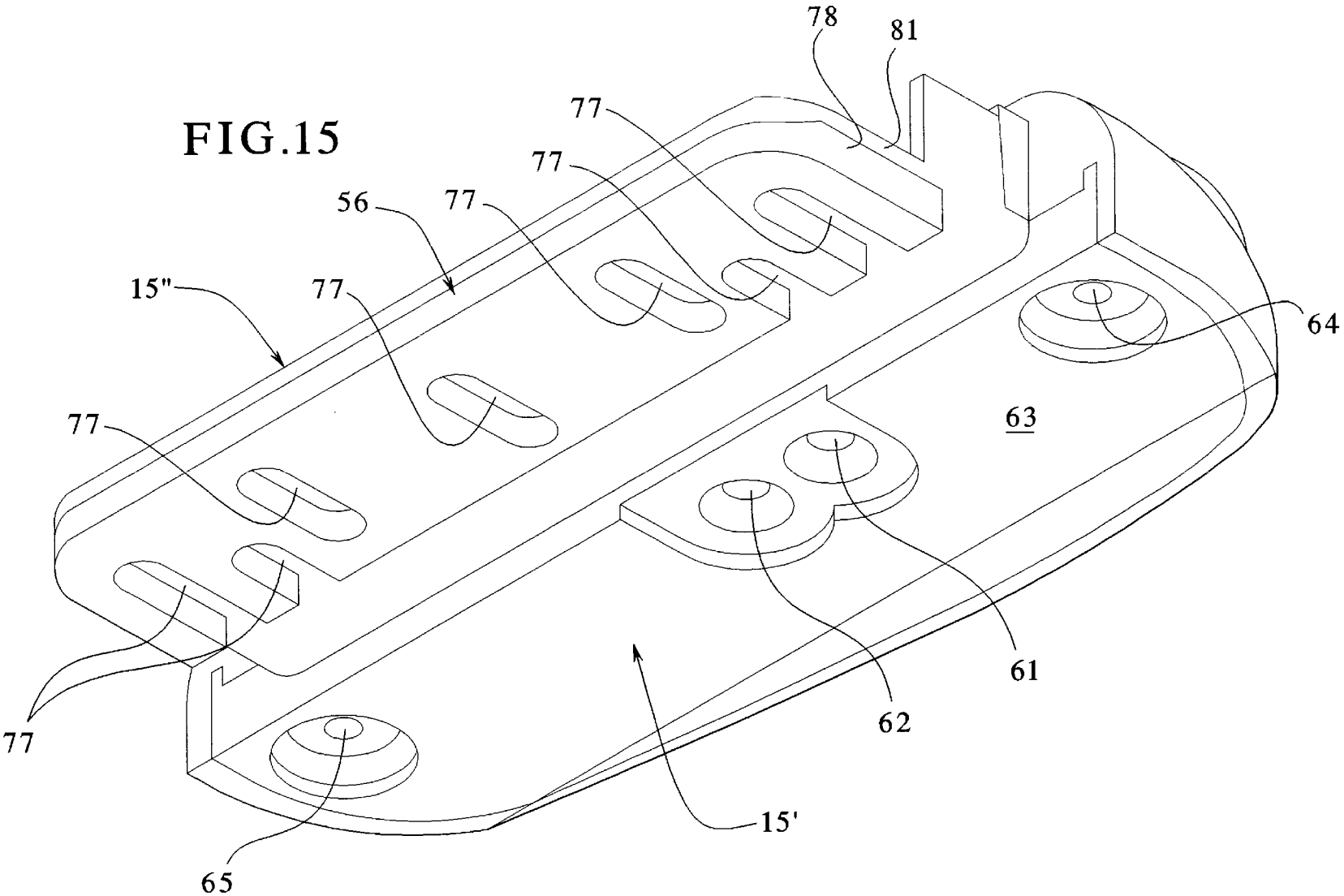
FIG. 15 is a bottom perspective view of the base of the present invention as attached to the spacer and escutcheon.

Referring to FIG. 4 and FIG. 15, it will be noted that the underside 57 of the elongated flange 21 includes a downward protrusion 58 that is spaced apart from an axial hole 59 that extends through the shaft 22. The axial hole 59 receives a screw (not shown) that extends through one of the holes 61, 62 that extend through the underside 63 of the base 15. Thus, in either position, the bushing 19 can be secured in place. Further, the protrusion 58 plugs the other of the holes 61, 62 that are not used to receive a screw for securing the retainer 19 in place. The holes 64, 65 (see also FIGS. 5 and 6) are utilized to secure the escutcheon 11 to the base 15. The remaining holes 66 are utilized to secure the base 15 to the window.

Figure 7:
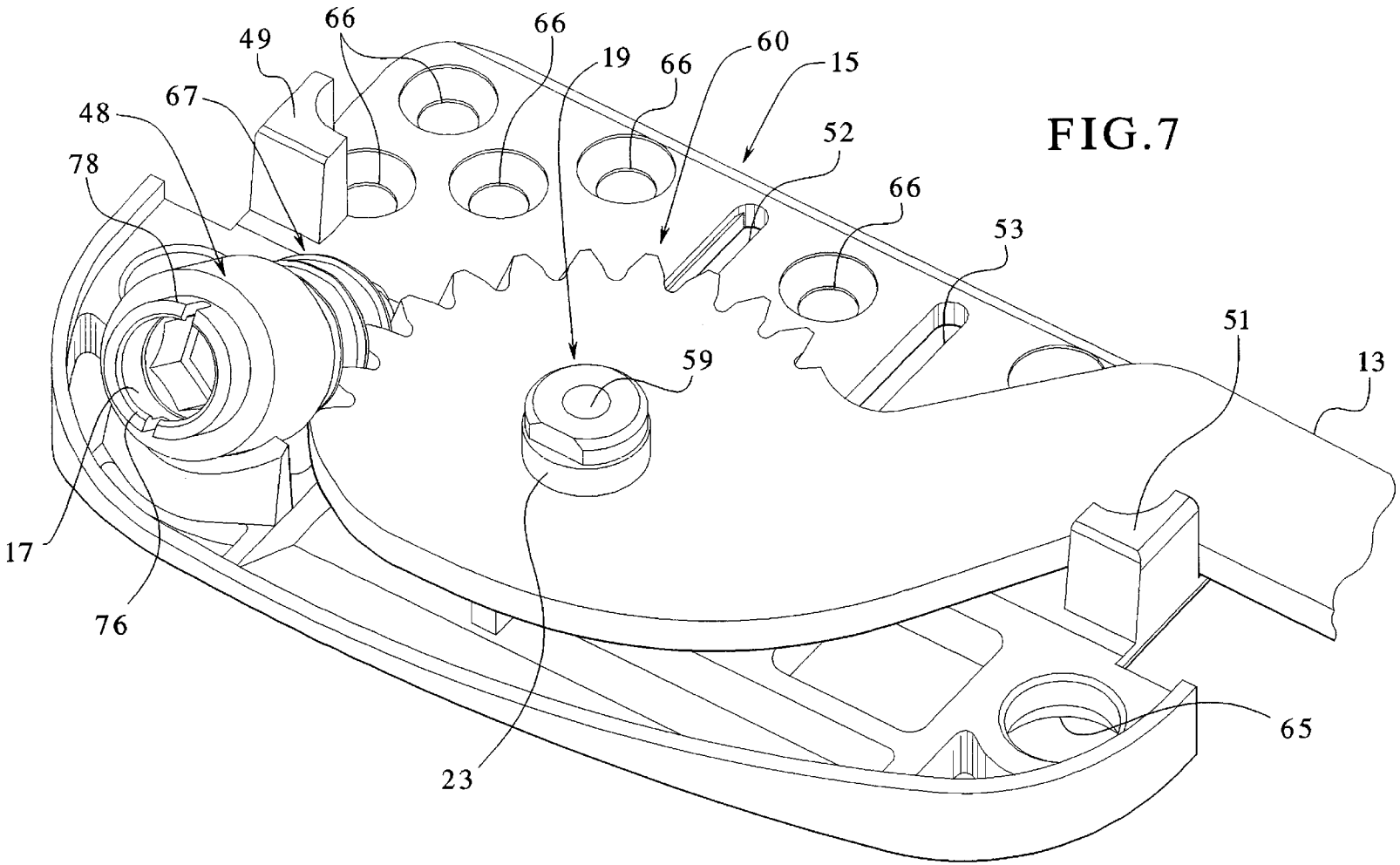
FIG. 7 is a perspective view of the base, worm drive assembly and bushing of the present invention as fitted with a portion of a single arm drive mechanism.

FIG. 7 illustrates the base 15 with the bushing 19 configured for the arm 13 of a single arm drive mechanism. The arm 13 is connected to an arcuate gear sector 60 having an axis defined by the shaft 23 of the bushing 19. The gear sector 16 engages the worm gear 67 as shown. Referring to FIGS. 9 and 7, the worm gear 67 includes shafts 68, 69 at opposite ends thereof. The shaft 69 is received in the lower thrust bearing 46 which is accommodated in the angled recess 45 (see FIGS. 5 and 6). The shaped shaft 68 is received in the drive coupling 71 which, in turn, is received in the retainer bushing 48. The drive coupling 71 includes a shaped hole 72 for receiving an end 73 of the drive shaft 70 crank handle 12. The end 73 of the drive shaft 70 of the handle 12 also includes a cylindrical portion 74 which includes a circumscribed recess 75. The recess 75 receives the bead 76 disposed at the upper inside surface 77 of the top end 78 of the retainer bushing 48 (see also FIG. 10). The cooperation of the bead 76 and circumscribed recess 75 provides a snap fit between the retainer bushing 48 and the handle 12. Further, the cooperation between the shaped end 73 of the handle 12 and the shaped hole 72 of the drive coupling 71 ensures an efficient transmission of torque from the handle 12 to the worm gear 67.

Figure 8:
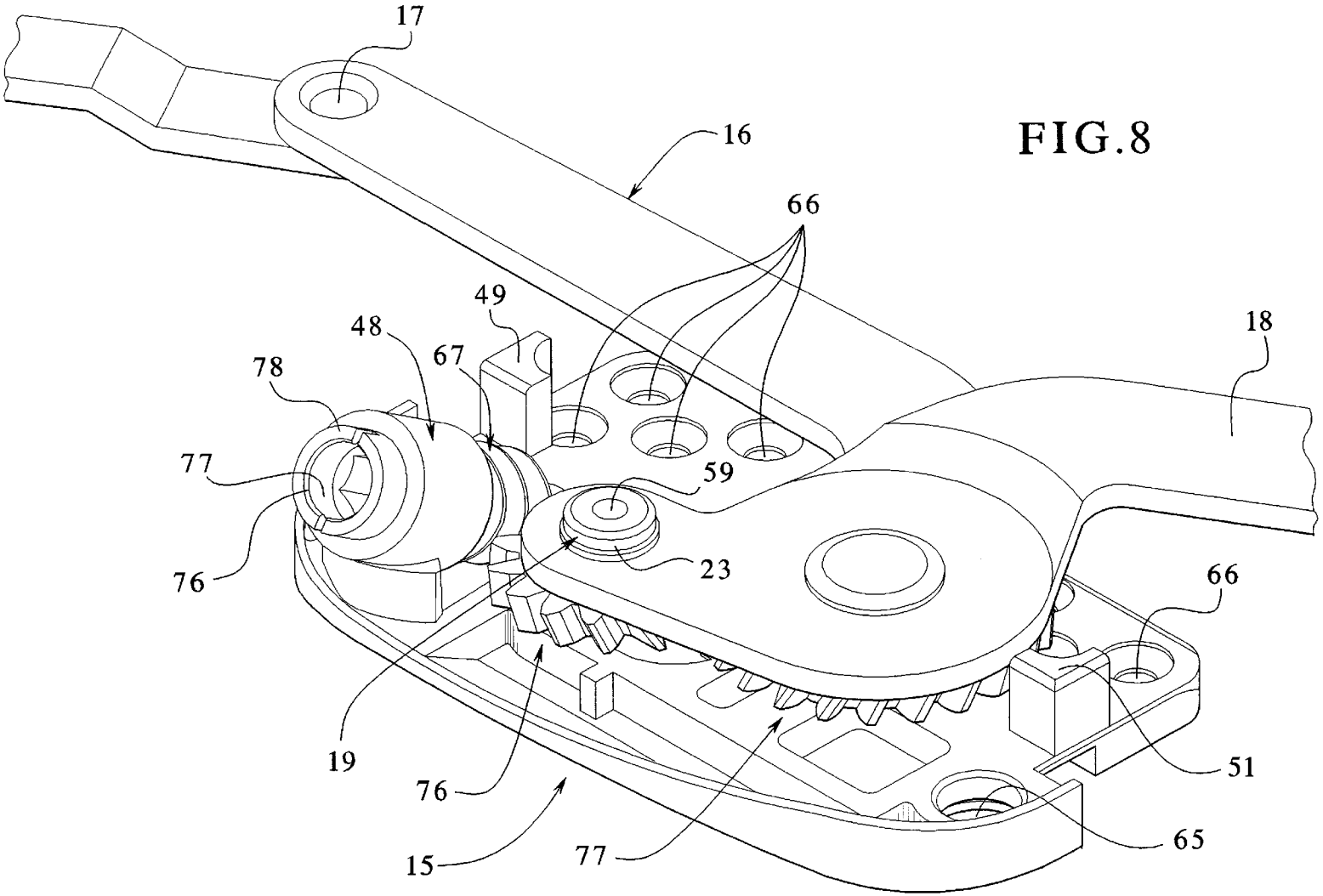
FIG. 8 is a perspective view of the worm drive assembly, base and bushing of FIG. 7 as equipped with a dual arm drive mechanism.

FIG. 8 illustrates the base 15 and bushing 19 of the present invention configured for a dual arm drive mechanism. Specifically, the bushing 19 has been rotated so that the shaft 23 is closer to the worm drive 67 so that the smaller gear sector 76 can engage the worm gear 67. The gear sector 76 meshes with the gear sector 77 thereby rotating the arm 16. The pivoting arm 18 pivots about the axis defined by the shaft 22.

FIGS. 11 and 12 further illustrate the spacer 56. As noted above, the upwardly directed protuberances 54, 55 are received in the slots 52, 53 respectively of the base 15 (see FIGS. 5 and 6). The remaining slots, shown generally at 77, enable the spacer 56 to be slidably connected to the base 15. The connection of the spacer 56 to the base 15 is further illustrated in FIGS. 13–15.

Figure 13:
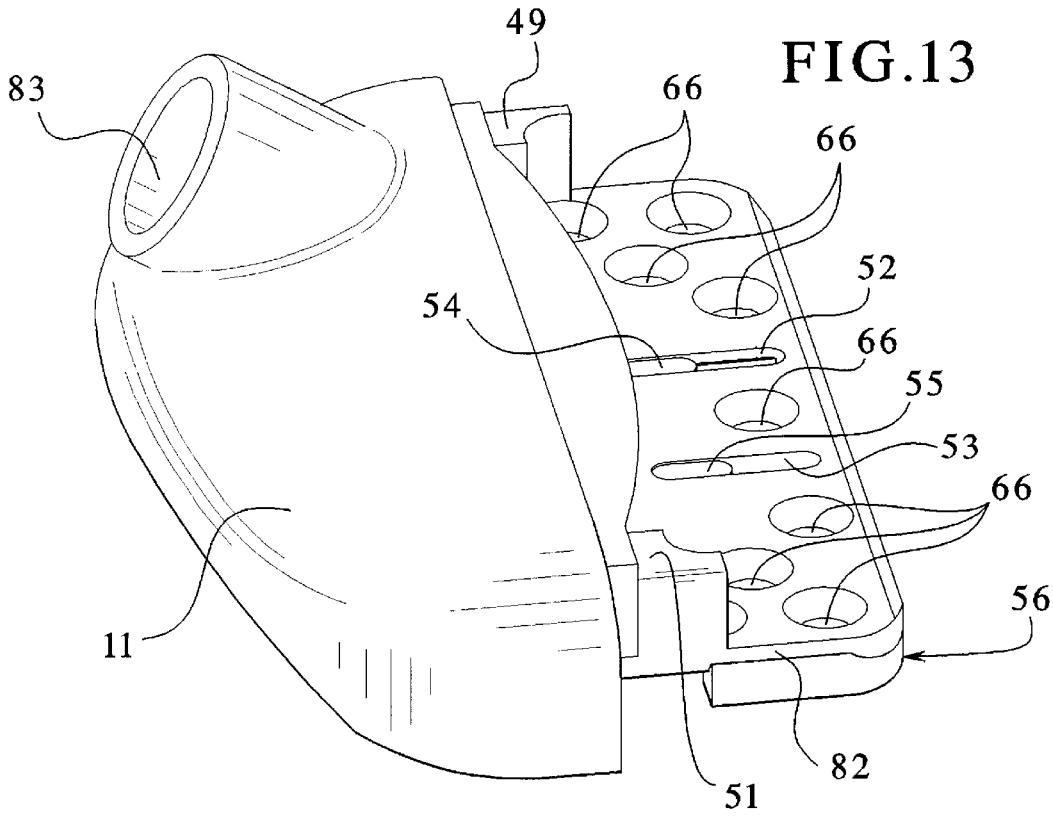
FIG. 13 is a side perspective view of the housing and spacer made in accordance with the present invention.
Figure 14:
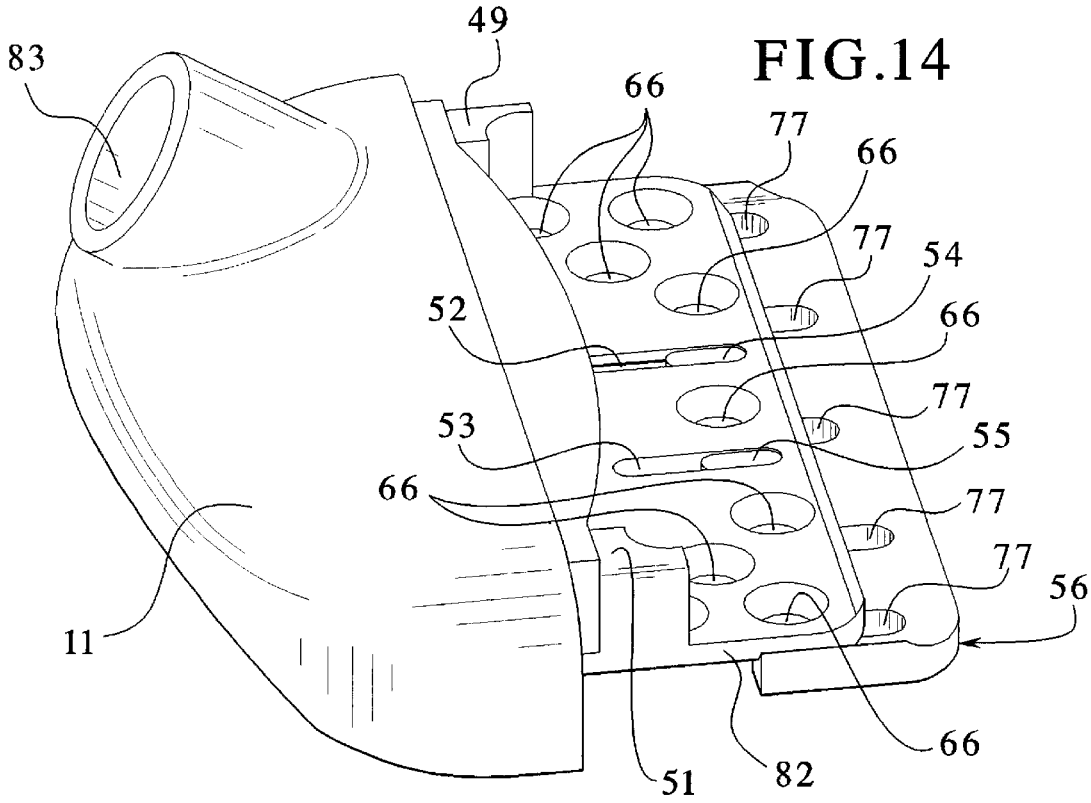
FIG. 14 is a side perspective view of the housing and spacer shown in FIG. 13 with the spacer moved laterally outward.

Specifically, spaced fins 78, 79 disposed at opposing ends of the spacer 56 are sized to receive the end walls 81, 82 of the base 15. The protuberances 54, 55 are received in the slots 52, 53 respectively. Screws or other suitable fasteners are inserted downward through the hole 66 to one of the slots 77 of the spacer. The position of the spacer can be slidably adjusted and then the screws tightened down to secure the relationship of the spacer 56 to the base 15 and the window (not shown). Also shown in FIGS. 13 and 14 is the hole 83 in the escutcheon 11 for receiving the handle 12. The base 15 further comprises an underside comprising a first portion 15' disposed beneath the escutcheon 11 and a second portion 15" that extends rearward from the first portion 15'. The spacer 56 detachably and slidably engages the second portion.

Turning to FIGS. 16 and 17, the configuration of the underside 34 of the escutcheon 11 is illustrated. The opening 83 for receiving the handle also leads to a cylindrical support 84 for providing additional support to the retainer bushing 48 and worm drive 67. The holes 85, 86 are in registry with the holes 64, 65 of the base (see FIGS. 5 and 6) and receive the screws that extend upward through the holes 64, 65 of the base to secure the escutcheon 11 to the base 15.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A casement window operator comprising:

a base connected to an escutcheon, the base and escutcheon forming a housing for accommodating a drive gear, the base comprising an elongated recess, a bushing comprising an elongated flange having a first end and a second end, the flange being connected to a shaft that extends upward from the flange, the shaft being connected to the flange at an eccentric position that is closer to the first end of the flange than the second end of the flange, the flange of the bushing being removably and mateably accommodated in the elongated recess of the base, the drive gear being mounted onto the shaft wherein the bushing is adapted to be removed from the elongated recess, rotated and reinserted into the elongated recess to relocate the shaft and drive gear with respect to the base.

2. The casement window operator of claim 1 wherein the flange further comprises a raised surface that encircles the shaft and acts as a bearing support for the drive gear.

3. The casement window operator of claim 1 wherein the shaft comprises an axial hole extending therethrough for accommodating a screw, and the recess of the base further includes a first hole and a second hole, the first hole accommodating the screw and being in alignment with the axial hole of the shaft when the flange of the bushing is mateably accommodated in the elongated recess in a first position, the second hole accommodating the screw and being in alignment with the axial hole of the shaft when the flange of the bushing has been rotated and is mateably accommodated in the recess in a second position.

4. The casement window operator of claim 3 wherein the flange comprises an underside, the underside of the flange comprising a protrusion that is spaced apart from the axial hole of the shaft, the protrusion being mateably accommodated in the second hole of the base when the flange of the bushing is in the first position, the protrusion being mateably accommodated in the first hole of the base when the flange of the bushing is in the second position.

5. The casement window operator of claim 1 wherein the escutcheon comprises an underside and the shaft comprises a top end disposed opposite an end of the shaft connected to the flange, the top end of the shaft engaging the underside of the escutcheon.

6. The casement window operator of claim 5 wherein the underside of the escutcheon comprises a first recess and a second recess, the first recess receiving the top end of the shaft when the bushing is in a first position, the second recess receiving the top end of the shaft when the bushing is in a second position.

7. The casement window operator of claim 6 wherein the top end of the shaft is tapered.

8. The casement window operator of claim 1 wherein the first end of the flange of the bushing comprises a notch and the second end of the flange of the bushing comprises a notch, the elongated recess comprising a first end and a second end, the first end of the elongated recess comprising a projection for mateably engaging one of the notch of the first end of the flange and the notch of the second end of the flange, the second end of the elongated recess comprising a projection for mateably engaging one of the notch of the first end of the flange and the notch of the second end of the flange.

9. The casement window operator of claim 1 wherein the bushing is rotated 180° to relocate the shaft and drive gear with respect to the base.

10. The casement window operator of claim 1 wherein the base comprises an underside comprising a first portion disposed beneath the escutcheon and a second portion that extends rearward from the first portion, and wherein the window operator further comprises a spacer that engages the second portion of the underside of the base.

11. The casement window operator of claim 10 wherein the spacer is detachably and slidably connected to the second portion of the underside of the base.

12. The casement window operator of claim 1 further comprising a worm drive assembly, the base further comprising an angled recess and an angled support, the worm drive assembly comprising a worm gear, a lower thrust bushing, a drive coupling and a retainer bushing, the worm gear comprising two ends, one of the ends of the worm gear being connected to the lower thrust bushing, the lower thrust bushing being received in the angled recess of the base, the other one of the ends of the worm gear connected to the drive coupling, the drive coupling connected to the retainer bushing, the retainer bushing engaging the angled support of the base, the worm drive assembly being entirely disposed between the escutcheon and the base.

13. The casement window operator of claim 12 wherein the escutcheon comprises an underside and the retainer bushing comprises a top end that engages the underside of the escutcheon.

14. The casement window operator of claim 13 further comprising a handle, the handle comprising an end, the escutcheon further comprising a hole for receiving the handle, the hole being aligned with the worm drive assembly, the end of the handle being mateably received in the top end of the retainer bushing.

15. The casement window operator of claim 14 wherein the end of the handle comprises a sidewall having a recess circumscribed therein and the top end of the retainer bushing comprises an radially inwardly protruding bead, the bead being received in the recess of the end of the handle when the end of the handle is mateably received in the top end of the retainer bushing.

16. The casement window operator of claim 12 wherein the angled support of base and the angled recess of the base support the worm drive assembly at an angle with respect to the base.

17. A casement window operator comprising:

a base connected to and disposed beneath an escutcheon, the base and escutcheon forming a housing for accommodating a worm drive assembly, the base comprising an angled recess and an angled support, the worm drive assembly comprising a worm gear, a lower thrust bushing, a drive coupling member and a retainer bushing, the worm gear comprising two ends, one of said ends of the worm gear being connected to the lower thrust bushing, the lower thrust bushing being received in the angled recess of the base, the other one of said ends of the worm gear being operatively connected to the drive coupling member for being rotatably driven by said drive coupling member, the drive coupling member being connected to the retainer bushing the retainer bushing engaging the support of the base, the escutcheon comprises an underside and the retainer bushing comprises a top end that engages the underside of the escutcheon, a handle, the handle comprising a drive shaft fixedly connected thereto, the handle comprising an end, the escutcheon further comprising a hole for receiving the drive shaft of the handle, the hole being aligned with the worm drive assembly, the drive shaft of the handle being removably received in the top end of the retainer bushing.

18. The casement window operator of claim 17 wherein the angled support of the base and the angled recess of the base support the worm drive assembly at an angle with respect to the base.

19. The casement window operator of claim 17 wherein the drive shaft of the handle comprises a sidewall having a recess circumscribed therein and the top end of the retainer bushing comprises an radially inwardly protruding bead, the bead being received in the recess of the drive shaft of the handle when the drive shaft of the handle is received in the top end of the retainer bushing.

* * * * *